US010729966B1

(12) United States Patent
Zenas et al.

(10) Patent No.: US 10,729,966 B1
(45) Date of Patent: Aug. 4, 2020

(54) LED SCREEN FOR USE IN INTERACTIVE GOLF DRIVING RANGES

(71) Applicant: DRĪV Enterprises, Inc., Studio City, CA (US)

(72) Inventors: Joe Zenas, South Pasadena, CA (US); Francois Bergeron, Studio City, CA (US); Craig Robert Hanna, Los Angeles, CA (US); Francois Girard, Vernon (CA); Jason Podollan, Vernon (CA); Randy Ewing, Beijing (CN); Thadeus Reed, San Francisco, CA (US); Ethan Jackson, Studio City, CA (US); Daniel Bae, Glendale, CA (US)

(73) Assignee: DRĪV Enterprises, Inc., Studio City, CA (US)

( * ) Notice: Subject to any disclaimer, the term of this patent is extended or adjusted under 35 U.S.C. 154(b) by 70 days.

(21) Appl. No.: 15/942,916

(22) Filed: Apr. 2, 2018

Related U.S. Application Data

(60) Provisional application No. 62/483,149, filed on Apr. 7, 2017.

(51) Int. Cl.

| | |
|---|---|
| ***A63B 69/36*** | (2006.01) |
| ***A63B 71/06*** | (2006.01) |
| ***G09G 3/32*** | (2016.01) |
| ***A63B 71/04*** | (2006.01) |
| *A63B 24/00* | (2006.01) |

(52) U.S. Cl.
CPC ..... *A63B 71/0622* (2013.01); *A63B 69/3658* (2013.01); *A63B 69/3697* (2013.01); *A63B 71/04* (2013.01); *G09G 3/32* (2013.01); *A63B 69/3691* (2013.01); *A63B 2024/0028* (2013.01)

(58) Field of Classification Search
CPC .... A63B 2024/0034; A63B 2071/0638; A63B 24/0021; A63B 67/02; A63B 69/3658; A63B 71/0622; A63B 69/36; A63B 69/3697; A63B 2225/20; A63B 69/3694; A63B 2024/004; A63B 2071/0636; A63B 69/3691; A63B 71/06; A63F 13/335
See application file for complete search history.

(56) References Cited

U.S. PATENT DOCUMENTS

| | | | | |
|---|---|---|---|---|
| 2002/0017844 | A1* | 2/2002 | Parkyn | G09F 9/33 313/113 |
| 2002/0065567 | A1* | 5/2002 | Kodera | A63B 69/3694 700/92 |
| 2006/0055641 | A1* | 3/2006 | Robertus | G09F 9/33 345/82 |

(Continued)

OTHER PUBLICATIONS

Dean Takahashi, Golfstream turns golf into a hilarious augmented reality sport, VentureBeat, Feb. 16, 2016.

*Primary Examiner* — Justin L Myhr
(74) *Attorney, Agent, or Firm* — Van Pelt, Yi & James LLP

(57) ABSTRACT

An LED screen for use in interactive golf driving ranges is disclosed. In an embodiment, a system includes a plurality of enclosures each housing LED nodes, where the plurality of enclosures is arranged in a plurality of rows to form an LED screen. The system also includes a coupler configured to couple a first one of the plurality of enclosures to a second one of the plurality of enclosures. The system also includes an LED processor configured to control each of the nodes via the coupler to display media on the LED screen.

23 Claims, 9 Drawing Sheets

(56) References Cited

U.S. PATENT DOCUMENTS

| | | | | |
|---|---|---|---|---|
| 2006/0287137 | A1* | 12/2006 | Chu | A63B 47/025 473/422 |
| 2007/0238539 | A1* | 10/2007 | Dawe | A63B 24/0003 473/131 |
| 2009/0121988 | A1* | 5/2009 | Amo | G09G 3/2088 345/82 |
| 2011/0134640 | A1* | 6/2011 | Bertele | G09F 9/33 362/249.02 |
| 2012/0309477 | A1* | 12/2012 | Mayles | A63F 13/428 463/3 |
| 2013/0274025 | A1* | 10/2013 | Luciano, Jr. | A63B 69/3658 473/156 |
| 2016/0287967 | A1* | 10/2016 | Baldwin | A63B 24/0021 |

* cited by examiner

400

LED SCREEN FOR USE IN INTERACTIVE GOLF DRIVING RANGES

CROSS REFERENCE TO OTHER APPLICATIONS

This application claims priority to U.S. Provisional Patent Application No. 62/483,149 entitled LED MESH SCREEN FOR USE IN INTERACTIVE GOLF DRIVING RANGES filed Apr. 7, 2017 which is incorporated herein by reference for all purposes.

BACKGROUND OF THE INVENTION

Golfers use driving ranges to practice their shots. They might use different clubs to hit balls towards field targets in the driving range. Players train by improving their swing to make more accurate shots. In a typical driving range, a player has a dedicated lane or bay and hits the ball towards the back wall of the driving range, aiming for targets placed on the field at various distances. Sometimes, players go to driving ranges for fun, socializing with other players while practicing their swing. There is a need for an augmented driving range that provides a more informative or fun experience for a player.

BRIEF DESCRIPTION OF THE DRAWINGS

Various embodiments of the invention are disclosed in the following detailed description and the accompanying drawings.

DETAILED DESCRIPTION

The invention can be implemented in numerous ways, including as a process; an apparatus; a system; a composition of matter; a computer program product embodied on a computer readable storage medium; and/or a processor, such as a processor configured to execute instructions stored on and/or provided by a memory coupled to the processor. In this specification, these implementations, or any other form that the invention may take, may be referred to as techniques. In general, the order of the steps of disclosed processes may be altered within the scope of the invention. Unless stated otherwise, a component such as a processor or a memory described as being configured to perform a task may be implemented as a general component that is temporarily configured to perform the task at a given time or a specific component that is manufactured to perform the task.

As used herein, the term 'processor' refers to one or more devices, circuits, and/or processing cores configured to process data, such as computer program instructions.

A detailed description of one or more embodiments of the invention is provided below along with accompanying figures that illustrate the principles of the invention. The invention is described in connection with such embodiments, but the invention is not limited to any embodiment. The scope of the invention is limited only by the claims and the invention encompasses numerous alternatives, modifications and equivalents. Numerous specific details are set forth in the following description in order to provide a thorough understanding of the invention. These details are provided for the purpose of example and the invention may be practiced according to the claims without some or all of these specific details. For the purpose of clarity, technical material that is known in the technical fields related to the invention has not been described in detail so that the invention is not unnecessarily obscured.

Golfers can practice without going to a golf course by going to a driving range. At a driving range, a golfer can by hitting targets on a green. Feedback about the swing can be provided to improve the golfer's skills. Typically, feedback is provided by another person such as a coach. A driving range has a perimeter defined by a sports net and a back wall. The golfer swings towards the back wall.

Figure 1:
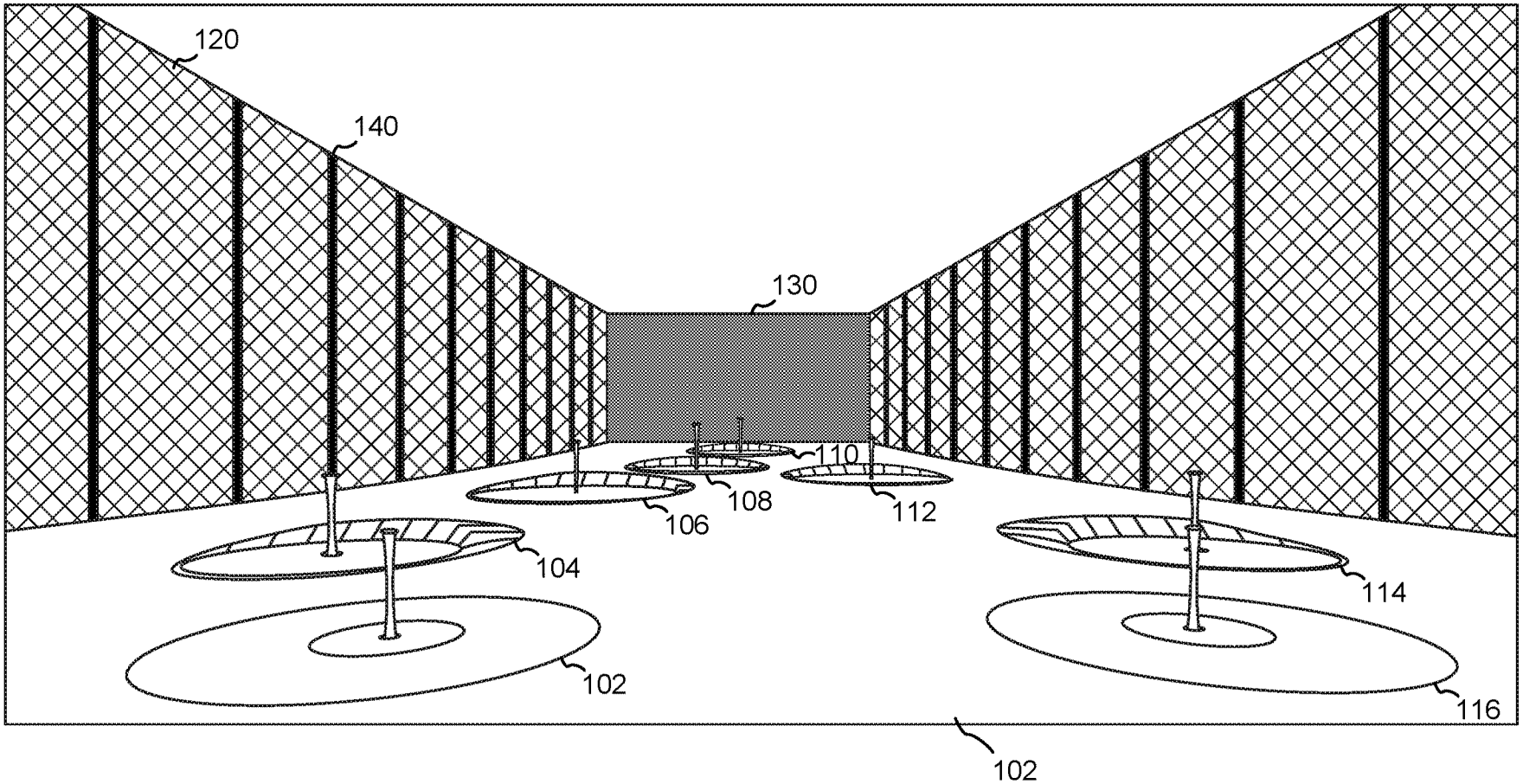
FIG. 1 shows an example of a driving range in which an LED screen disclosed here finds application.

FIG. 1 shows an example of a driving range in which an LED screen disclosed here finds application. The driving range is defined by a sports net 120 around the perimeter of the field 102. The sports net is tensioned to stop the travel of balls outside the area defined by the sports net. The sports net can be treated to be weather resistant. For example, the sports net may be UV coated to prevent fading from prolonged exposure to the sun. In various embodiments, the sports net appears transparent at a distance to give the player a sensation of openness. The more transparent the sports net is, the less obstruction there is to objects provided in the driving range such as the LED screen described below. In some embodiments, the sports net protects objects from damage. For example, the sports net is, in various embodiments, installed in front an LED screen to prevent balls from hitting the LED screen. The sports net is supported by poles 140 placed around the perimeter of the driving range. The height of the poles may vary depending on the expected travel or positions of golf balls at various locations around the driving range.

The side of the driving range directly opposite the golfer is called the back wall 130. This view of the driving range is from the perspective of a player standing directly opposite the back wall. Typically, a back wall is provided in a driving range to keep balls inside the driving range. The back wall defines the end of the driving range.

The field includes field targets 102-116 placed at various distances. In a typical practice session, the player hits the golf ball towards the back wall while aiming for the field targets. As shown, the targets can have a variety of designs. Some of the targets such as targets 102 and 116 show a range around a hole. Some of the targets such as targets 104-114 have raised portions, which may be colored differently to indicate the difficulty of hitting that target or to indicate a classification of that target.

Games can be designed around the targets. For example, the field targets can be one of two colors: red and blue. Players on one team aim for the red targets and players on another team aim for the blue targets. Targets can be assigned different values and a successful hit of the target earns a player a specified number of points corresponding to the difficulty of hitting that target. The value of the target can be visually designated by its color or other marking. In some embodiments, the marking of the targets can be digitally altered. For example, a lighting (such as programmable LED lighting) around, below, or on top of the target displays a color and the color or design of the target can be quickly and automatically changed without physically altering the field targets. As more fully described with respect to FIG. 9, some of the field targets may be virtual targets simulated by a display. The field accommodates physical targets, virtual targets, or a mix. In some embodiments, some targets can be simulated on the LED screen behind the back wall, as more fully described below. When a player attempts to hit a target, the speed, accuracy, and other measures of the swing can be sensed and recorded. Examples of how the ball is tracked is more fully described below.

Typical back walls of driving ranges, like the one shown here, are bland and blend unobtrusively into the background. For example, the back wall is typically a solid color and not designed to be eye-catching. However, activating the back wall of the driving range with an LED screen may provide many benefits. Providing an LED screen in the vicinity of the back wall can augment the gaming experience, positively affect overall guest impression of the facility, and improve the productivity of a training session, among other things.

The techniques described here enhance a gaming experience by activating the back wall with video content to supplement the physical, real-world experience of being at a driving range. For example, the back wall is activated by providing an LED screen between a sports net and the back wall. In addition to the physical field targets, the player has additional points to look at, and, depending on the design of the game, additional virtual targets to aim for. For example, the visualized expanse of the driving range can be augmented by simulating a longer and larger driving range. Additional targets or green space can be displayed on the LED screen to visualize a longer driving range than the physical dimensions of the field. As another example, feedback rendered on the back wall can provide information about how close a player came to a target, statistics about the player's technique, and coaching advice. A driving range such as the one pictured in FIG. 1 typically has a field that is open-air or outdoors. However, a driving range can be indoors as well. The techniques described here apply to both settings.

An LED screen for use in interactive golf driving ranges is disclosed. The techniques described here provide an augmented reality experience for a player by augmenting a real-world, physical environment with computer-generated information such as a visual overlay (an overlay to a back wall). Although chiefly described using the example of an entertainment golf facility, the LED screen finds application in a variety of other settings including other sporting and entertainment media facilities. In an embodiment, a system includes a plurality of enclosures each housing LED nodes, where the plurality of enclosures is arranged in a plurality of rows to form an LED screen. The system also includes a coupler configured to couple a first one of the plurality of enclosures to a second one of the plurality of enclosures. The system also includes an LED processor configured to control each of the nodes via the coupler to display media on the LED screen.

Figure 2:
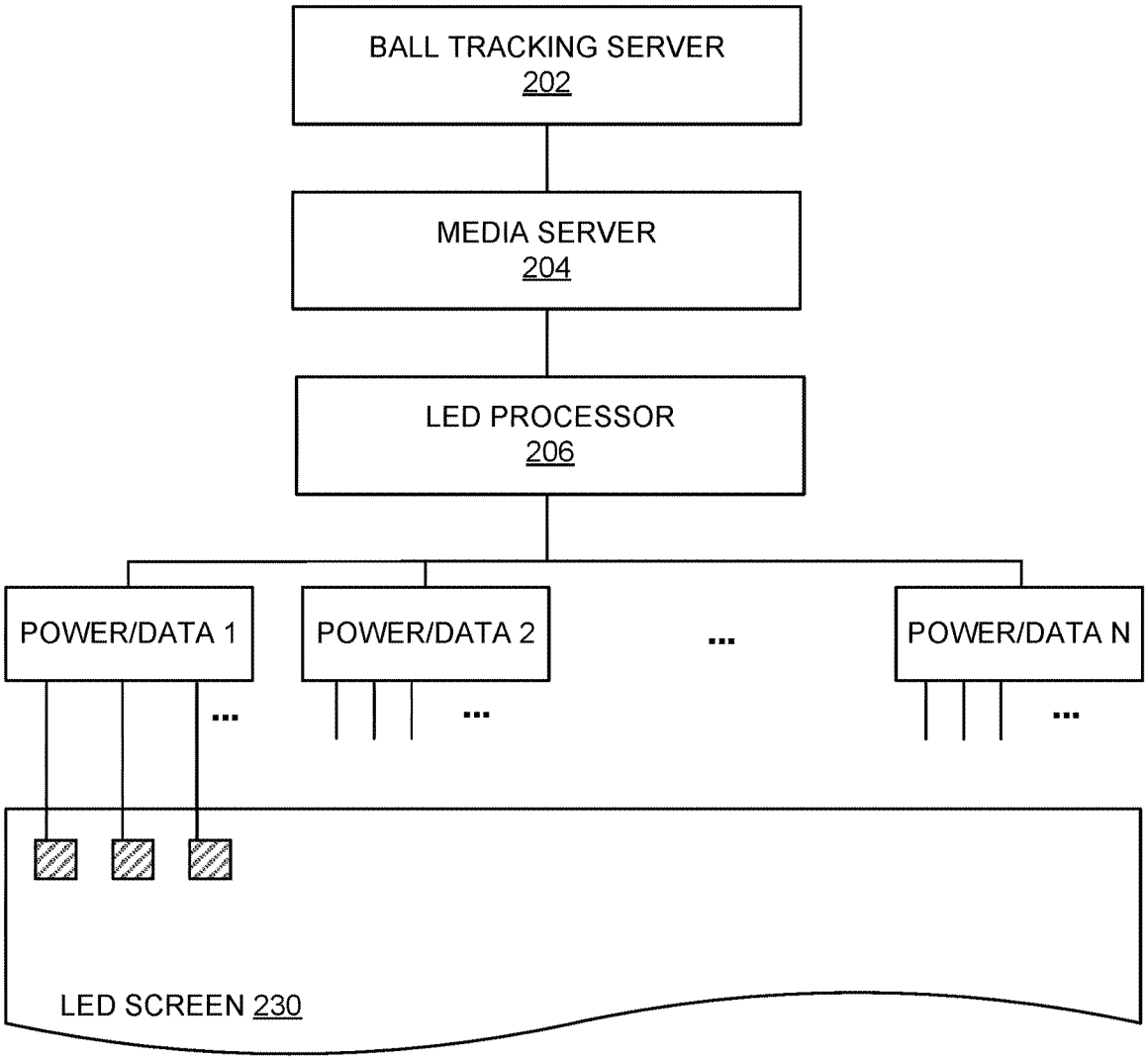
FIG. 2 is a block diagram illustrating an embodiment of an LED screen system.

FIG. 2 is a block diagram illustrating an embodiment of an LED screen system. The system includes LED screen 230, ball tracking server 202, media server 204, LED processor 206, and power supplies (labelled Power/Data 1 through Power/Data N). Each of the components may be communicatively coupled via a network as shown.

The LED screen 230 is configured to display media such as an image or video. In various embodiments, unlike conventional LED screens, the screen described here is of relatively low resolution, relatively large pixel pitch, and low brightness. The low resolution screen effectively displays media, while providing seamless integration with the surrounding environment. In one aspect, the screen is transparent, which makes augmented reality applications more natural. The screen is low cost (lower cost than conventional LED screens) and suitable for use outdoors including in unpredictable weather conditions because it is rugged. In some embodiments, the resolution of the screen is on the order of 10 pixels for a 0.75 in×12 ft. strip.

Figure 3:
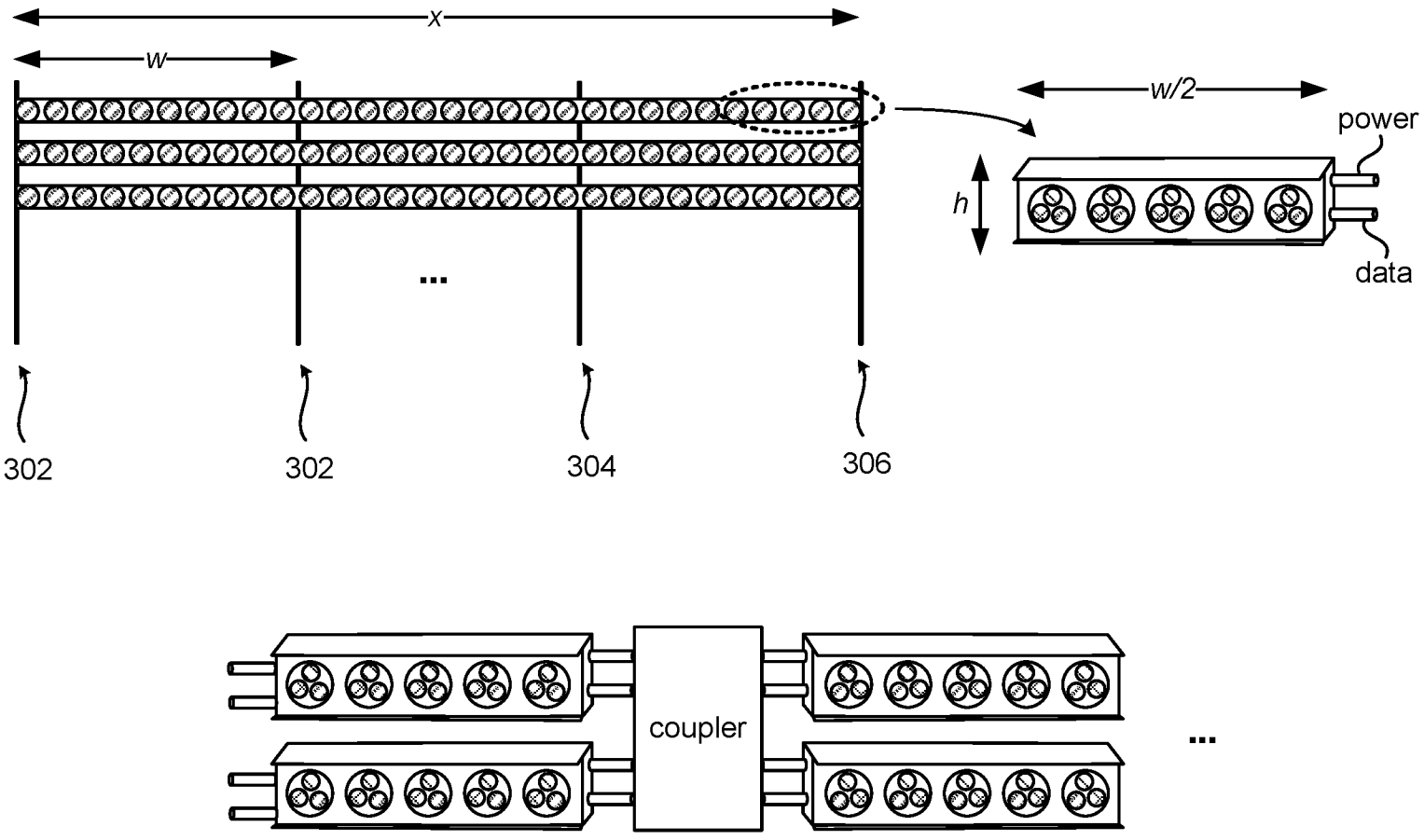
FIG. 3 shows an example of an LED screen.

In some embodiments, the LED screen is made up of a series of strips. For example, each strip houses several LED nodes and is sized to be approximately the height of the LED and the length of the number of LED nodes to be included in each strip. Strips may be connected end to end to form a long strip extending across the width the LED screen. Each strip is oriented in a horizontal direction, and spaced a fixed distance from the next strip. Each strip is attached to a vertical suspension cable at one or more points. For example, the strips are positioned 200 mm apart. An example of this type of screen is shown in FIG. 3.

In some embodiments, the LED screen is made up of a wire mesh substructure with nodes provided at intersections. For example, the LED screen is made up of a netting with nodes provided at each of the intersections. The netting can be sized based on a desired resolution of the screen, which can be based on cost or environment considerations. In some embodiments, the LED nodes are spaced 200 mm apart. The material of the netting can be similar to or the same as the sports net.

For both examples of LED screens described above, each node, in various embodiments, includes an array of LEDs to contribute to the image displayed by the LED screen. For example, each node include one or more red LEDs, one or more blue LEDs, and one or more green LEDs. The RGB LEDs are driven by an LED processor to project an image. The RGB LED nodes of the wire mesh substructure may be daisy-chained together allowing power and signal data to be transmitted or received. In various embodiments, each LED node may be individually addressable and automatically addressed once plugged into the daisy-chain.

In various embodiments, the LED screen (e.g., matrix of strips or wire mesh substructure) is provided substantially parallel to a back wall, e.g., a predefined distance from the back wall 130 of FIG. 1. In various embodiments, the LED screen may be provided behind the back wall. The LED screen may be configured to display animation, a movie, or an animated sequence in relation to a golf ball hitting or corning into close proximity to the screen. In various embodiments, in response to one or more balls contacting the LED screen 230 or coming into proximity with the screen, one or more graphics may be displayed. For example, golf balls may be tracked by a tracking system to determine when and what types of graphics to display on the screen.

Ball tracking server 202 is configured to track the trajectories of balls inside the driving range. The ball tracking server maintains a data stream corresponding to a path of the ball. For example, the balls may be tracked by a tracking system such as a 3D Doppler radar based tracking system. Sensors are provided in the driving range, and the location of the ball is triangulated. For example, a sensor is placed on each of three walls (including possibly a ceiling) of the driving range to obtain at least three data points for triangulation. In various embodiments, the 3D Doppler radar based tracking system has range terrain mapped such that the system can precisely determine a location in space where a ball would hit the back wall.

In some embodiments, several balls can be tracked simultaneously. A ball can be identified and associated with its player or bay of origin. For example, a 3D map file of the driving range is uploaded to the tracking server. From this terrain information, the bay locations are known. The origin of a ball being tracked is identified and associated with the bay where the ball originated. In some embodiments, only data associated with this ball is provided back to the associated bay. This provides relevant feedback to a particular user. The user might not be interested in information about adjacent bays, for example. In various embodiments, the range of the tracking system is adapted to the size of the driving range. A typical tracking system is able to track 33 bays across×3 bays high. Tracking systems can be designed to accommodate the expected number of bays in a sporting facility.

This tracking information can be used by the media server 204. In various embodiments, an overlay can be displayed over the trajectory of the ball. For example, as a ball travels in front of (across) the LED screen, a trail representing the trajectory of the ball is displayed on the screen to highlight the progression of the ball. Coordinate data may be sent to the media server to trigger pre-composed graphics content to originate at a location of the contact. In some instances, the graphics originate at the center of the contact at exactly those coordinates.

Media server 204 (sometimes called a video graphics server) is configured to provide media output (e.g., an image, a video) to LED processor 206. The media server is configured to map an image to channels corresponding to the LED nodes in the screen 230. In this regard, the media server is aware of the resolution of the LED screen and maps and scales the image for display on the screen. Unlike conventional LED screens that try to maximize resolution and brightness, the media server here maps and scales an image for adequate display on an LED screen for augmented reality applications. For example, if a game is being played at night, the LED screen brightness is reduced because a dimmer display is more comfortable to view at night and less energy is used to power the LEDs. The transparency due to the structure and relatively low resolution of the screen makes the experience more comfortable and realistic for players.

For example, a bulls eye is displayed on the LED screen by obtaining the image of the bulls eye from the media server. Media server 204, in cooperation with LED processor 206, maps the bulls eye to the appropriate LED nodes for display by determining which LED nodes should be lit up and what colors the respective LED nodes are to be displayed to form the graphic of the bulls eye. In some embodiments, content is displayed by media server 204 by playing pre-composed graphics content. For example, an uploaded video can be projected on the LED screen. In some embodiments, a sequence of graphics maybe determined dynamically based on the tracking of the ball. For example, a series of images are selected in response to the type of swing made by the player or the location/trajectory of the ball.

In various embodiments, media server 204 obtains ball data such as the flight or trajectory of the ball from ball tracking server 202 to determine what media is displayed. For example, the media server responds to information about where balls are as tracked by the ball tracking server. In response to a ball hitting a target, feedback is displayed on the LED screen. The feedback can be of various forms such as a ripple to simulate an object hitting water, fireworks at the location where the ball hit (or is projected to hit) the target, or a message like "nice shot!" The media displayed as feedback may pre-composed graphics content or a series of stored graphics stitched together on the fly and displayed on the screen. In some embodiments, the location where the pre-composed graphics content is displayed corresponds to where the target was hit. For example, the graphics can be displayed at the exact coordinates where the ball landed, touched a target or sports net in front of the screen, or came into proximity with a target. As another example, where the LED screen extends a range of the driving range, the graphics can reflect where the ball is expected to hit in the augmented range. Media server 204 outputs image signals to LED processor 206 to drive the LED nodes to display the image.

LED processor 206 is configured to instruct the power/data supplies to display the video using LED nodes 232-236 on LED screen 110. LED processor 206 may manage and map the incoming video graphics content from the video graphics media server 204 to an appropriate matrix of LEDs. The LED processor is aware of the resolution of screen 230 and locations of nodes on the screen. The LED processor splits signal data, and drives the LED nodes via the power supplies.

The power supplies (here, Power Supply 1 to Power Supply N) are each configured to power a respective LED node. In some embodiments, the power supplies are plugged into LED processor 206. Here, three example nodes are shown, although any number of LED nodes may be provided in an LED screen. As shown in FIG. 3, each of the LED strips in the matrix of strips has data and power connections. The power supplies provide power and/or data to each of the LED strips. For example, power supplies provide a data control signal to instruct an LED node when and how intensely to emit light. In some embodiments, the power supplies deliver power to each node directly such as in the case of the wire mesh substructure. The power supplies allow the brightness of the LED screen to be adjusted. For example, the brightness can be adapted to ambient conditions, which is typically brighter in broad daylight (around 4,000 nits) and dimmer at night. In various embodiments, power supplies convert AC to DC, and can store some power to continue lighting up the LED screen even in the case of power outages.

In various embodiments, the LED screen is observed by several players. For example, entertainment driving ranges have multiple tees, lanes, or bays, and players in the same bay or across different bays play a game together. The LED screen can display feedback for several players simultaneously, as more fully described with respect to FIGS. 8 and 9.

FIG. 3 shows an example of an LED screen. Any number of suspension cables and LED strips may be used to construct an LED screen of a desired size and resolution. In this example, the LED screen includes four vertical suspension cables 302, 304, 306, and 308 to support three rows of LED strips. The suspension cables are structured to be load-bearing such as metal wire, steel wire rope, and the like.

The LED strips here are each w (e.g., 12 feet) across and h (e.g., 0.75 inches) tall. LED strips may be sized differently, for example, less than 12 feet across for smaller screens or lower resolution and shorter if smaller LED nodes are used. In this example, the height of the LED strip is defined by the height of an LED node. The suspension cables are spaced every four feet and secured to the LED strip to provide support for the LED strip.

As shown, each LED strip houses several LED nodes. Each LED node includes a plurality of LEDs such as one or more red LEDs, one or more green LEDs, and one or more blue LEDs. A portion of an LED strip with five LED nodes is enlarged and shown in FIG. 3. Each LED strip may include one or more connectors to receive power and data. Here, a pair of connectors plugs into a power supply to receive power on one connection and data on another connection. Other types of connectors are possible, such as a single connection to deliver both power and data.

To create a row of LEDs over 12 feet long, two or more LED strips can be coupled together. The example coupler shown in FIG. 3 receives four LED strips. For clarity, the coupler is represented as a block in FIG. 3. In various embodiments, the coupler may be relatively much smaller than the LED strips so as to provide the illusion of a seamless row of LED nodes when two or more LED strips are coupled together. A single coupler would create an LED screen with two rows of LEDs that is 24 feet across. The spacing between LED strips can be adjusted. In some examples, each LED node is spaced 200 mm from the next LED node. Within an LED strip, the nodes can be spaced 200 mm apart and one row of LED strips can be spaced 200 mm from the next LED strip to create this example spacing.

The LED strips may be made from any rigid or semi-rigid material such as plastic. In some embodiments, the material is transparent or semi-transparent to facilitate integration with the visual surrounding of the LED screen in which the strips are provided. The spaces between horizontal strips, in various embodiments, are open to air, further providing transparency to and integration with the environment.

An LED screen made up of a series of strips may have several advantages over other types of LED screens. In one aspect, the LED screen is more rugged, tolerant of inclement weather conditions such as wind or ice. In another aspect, the LED screen is more transparent because less physical area is blocked. For example, the space between LED strips is open to the air. This can help augment a gaming experience because there is better integration with the physical environment. In yet another aspect, production costs can be decreased because the plastic strips, in various embodiments, are identical and fewer unique parts makes manufacturing less complicated and costly. The strips may be a commercially available component from a vendor. At the same time, modular LED strips allow a screen of any size and resolution to be constructed. That is, the LED screen is scalable and can be adapted to cost objectives, driving range size, anticipated media uses, and the like.

In various embodiments, regardless of whether the screen is made of LED strips or wire mesh, the screen is structured to maximize transparency and structural integrity. In various embodiments, the LED nodes are selected to provide a range of brightness from daylight-readable brightness to nighttime brightness, as well as constant outdoor use in a wide range of environmental conditions. In various embodiments, the brightness of the LEDs may be automatically adjusted based on ambient light sensor to maintain viewability during the day and night.

In an alternative embodiment, the LED screen is made up of a freestanding tensioned stainless steel stranded wire mesh substructure, with outdoor rated (e.g., minimum IP66) high brightness RGB LED nodes affixed to various positions across the wire mesh substructure, creating a custom LED matrix to display video graphics content. For an interactive golf driving range, an LED matrix of around 200 mm×200 mm may strike a desirable balance between resolution, brightness, and cost. However, the wire mesh substructure allows for an endless combination of LED matrices to fit various wall sizes and viewing distances.

Figure 4:
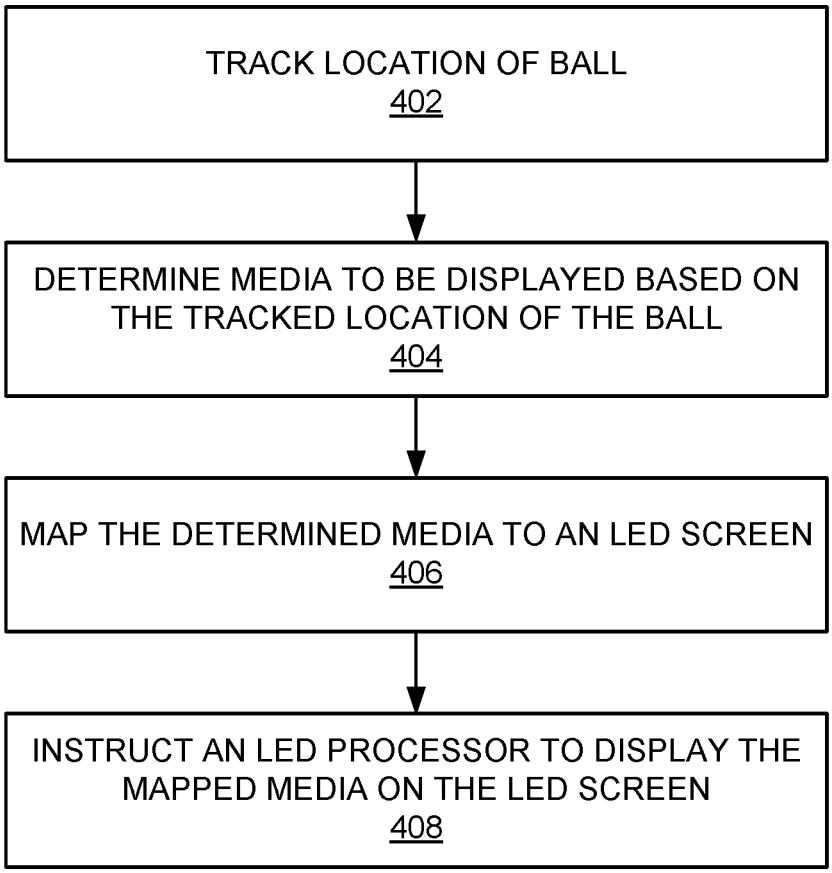
FIG. 4 is a flow chart illustrating an embodiment of a process for rendering images on an LED screen.

FIG. 4 is a flow chart illustrating an embodiment of a process for rendering images on an LED screen. Process 400 may be implemented by the system of FIG. 2 to display media on an LED screen such as the one described here.

At 402, the process tracks a location of a ball. In various embodiments, a location of a ball within a sporting facility such as a driving range is tracked. A trajectory of the ball (locations over time) can be tracked in a variety of ways including by a 3D Doppler radar system in which the location of a ball is triangulated based on readings made by sensors provided throughout the sporting facility. In some embodiments, the terrain of the sporting facility is known (e.g., stored), and the tracking of the ball is combined with the known terrain to determine an origin of the ball (e.g., the bay/lane/tee where a ball originated), whether the ball struck targets inside the sporting facility, and the like. Ball tracking is further described with respect to ball tracking server of FIG. 2.

Figure 5:
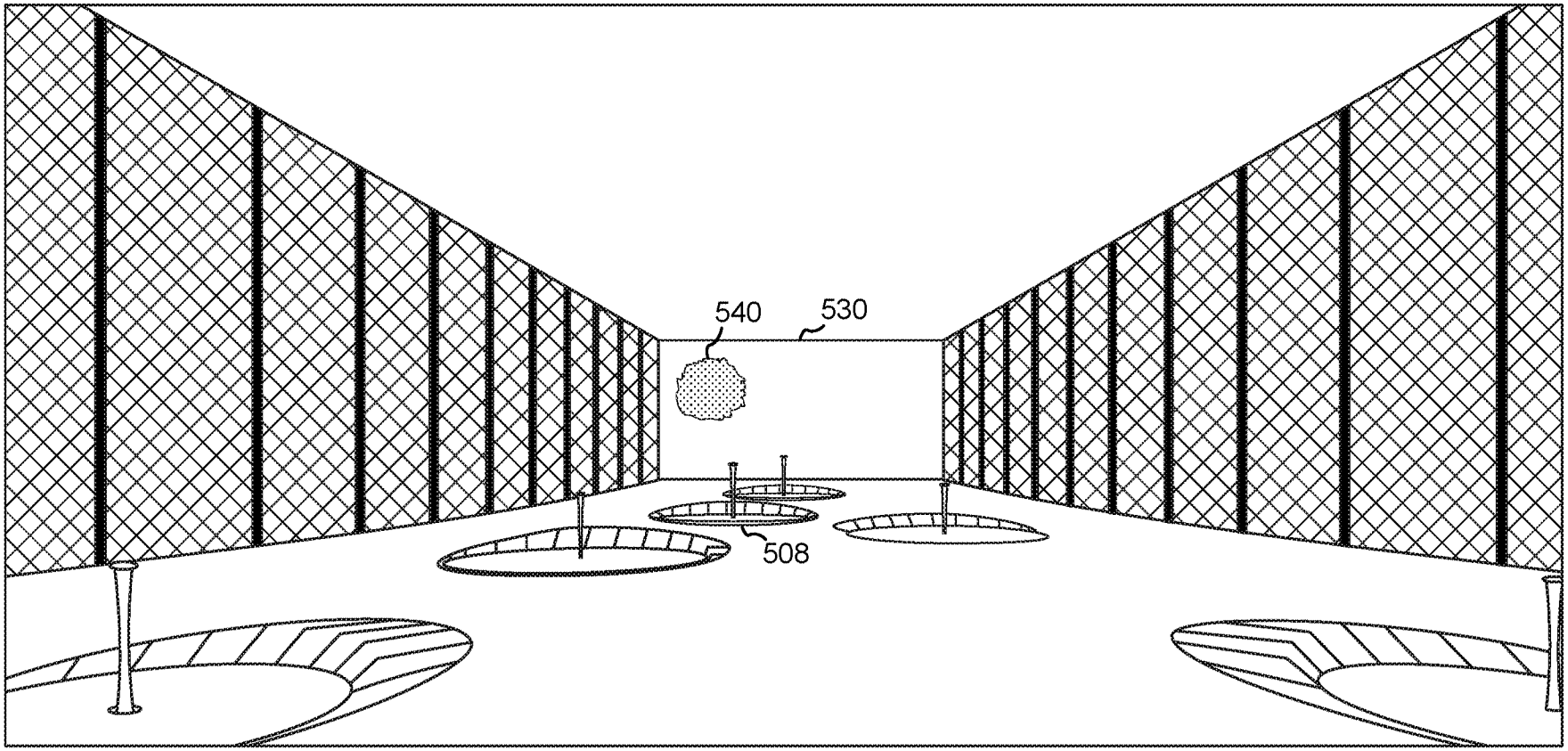
FIG. 5 shows an example of a driving range with an LED screen.

At 404, the process determines media to be displayed based on the tracked location of the ball. In various embodiments, media is displayed on an LED screen in response to locations of the ball. Referring to FIG. 5, media 540 is displayed on a back wall 530 of a driving range in response to a ball hitting target 508. Returning to FIG. 4, the type of media displayed depends on the tracked location(s) of the ball. For example, a ball may squarely hit a target, come within some threshold distance of the target, or miss the target. Each of these scenarios may cause a different media item to be displayed. This provides meaningful feedback to the player. For example, a player might not be able to see the field well, but feedback on the back wall may confirm to the player that a target was hit. The type of media may also reflect the degree of success of the player (e.g., how close to a target a ball lands). Using the example of displaying fireworks to indicate a ball hitting a target, larger or brighter fireworks indicate proximity to the center of the target. The type of media displayed may also provide feedback about the trajectory of a ball. For example, the trajectory of the ball is marked on the back wall (e.g., as a trail) the help the player better see the effect of the swing on the ball. This can help train the player to become better at the game. The media can also be used to implement a game in the sporting facility. For example, the objective of the game can be illustrated with the help of the media displayed on an LED screen, and process towards the objective may be displayed on the LED screen. The media may be dynamically determined based on stored image or videos. For example, pre-composed graphics of fireworks of varying sizes, colors, intensities, and the like are stored. Depending on the success of a hit, a corresponding fireworks is fetched from storage and displayed on the LED screen. As series of images or videos may be stitched together and displayed.

At 406, the process maps the determined media to an LED screen. After determining the media to be displayed at 405, the media is mapped to the LED screen based on the known size and resolution of the LED screen. Referring to FIG. 2, the LED screen includes a number of LED nodes. Each LED node is configured to display a color to make up the full image on the LED screen. The media that is to be displayed on the LED screen is mapped to appropriate channels of the LED screen. In some embodiments, this may include scaling (upsampling, downsampling) to map the media to the LED screen. In some embodiments, depending on ambient conditions (night time vs. day time), the brightness of the media is adjusted for comfortable viewing.

Returning to FIG. 4, at 408, the process instructs an LED processor to display the mapped media on the LED screen. In various embodiments, an LED processor receives media to be displayed on an LED screen and maps it to various power supplies. The power supplies in turn power respective LED nodes to render the media on the LED screen. The LED processor drives the LED nodes via the power supplies by providing a portion of the mapped data to the appropriate channel for display by individual LED nodes. Together, the LED nodes create image corresponding to the media to be displayed on the LED screen.

The following figures show examples use cases of the LED screen.

FIG. 5 shows an example of a driving range with an LED screen. The driving range shown in FIG. 5 is like the one shown in FIG. 1 with the exception of the back wall region. In various embodiments, an LED screen is provided as an overlay to the back wall. Here, an LED screen is provided in front of the back wall 530. In some embodiments, the LED screen is provided between a sports net and the back wall. Graphics are displayed on this LED screen to augment a gaming experience. Here, the example graphics are fireworks 540 displayed on the LED screen. For example, the fireworks is shown because a player has just hit a target. In some embodiments, the region of the LED screen in which the graphics is displayed corresponds to the location of the target. For example, when a player hits field target 508, fireworks 540 is displayed. The fireworks can be a pre-composed graphic as described above. The size or intensity of the fireworks can be based on the accuracy of the shot. For example, a perfect shot may be rewarded with a fireworks display at maximum intensity or size, and as the shot gets farther away from the center, fireworks decrease in size or intensity.

Figure 6:
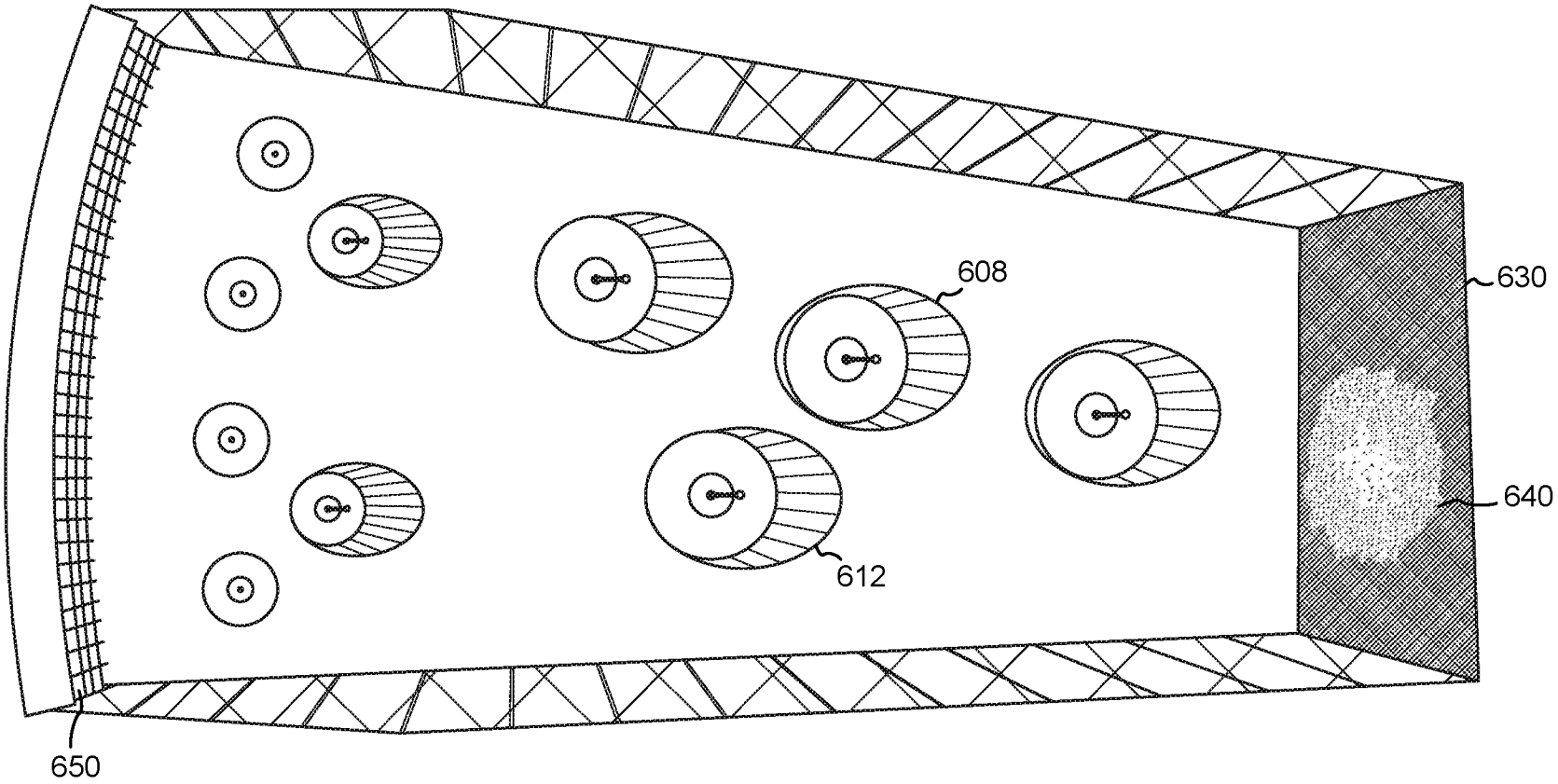
FIG. 6 is a top-down view of a driving range with an LED screen according to an embodiment of the present disclosure.

FIG. 6 is a top-down view of a driving range with an LED screen according to an embodiment of the present disclosure. The driving range shown in here corresponds to the one shown in FIG. 5. One or more players may be in bays 650 and hitting golf balls towards back wall 630. Fireworks 640 is displayed in response to a player hitting a target. For example, here, the fireworks are shown slightly to the right of the screen in response to field target 612 being hit.

Figure 7:
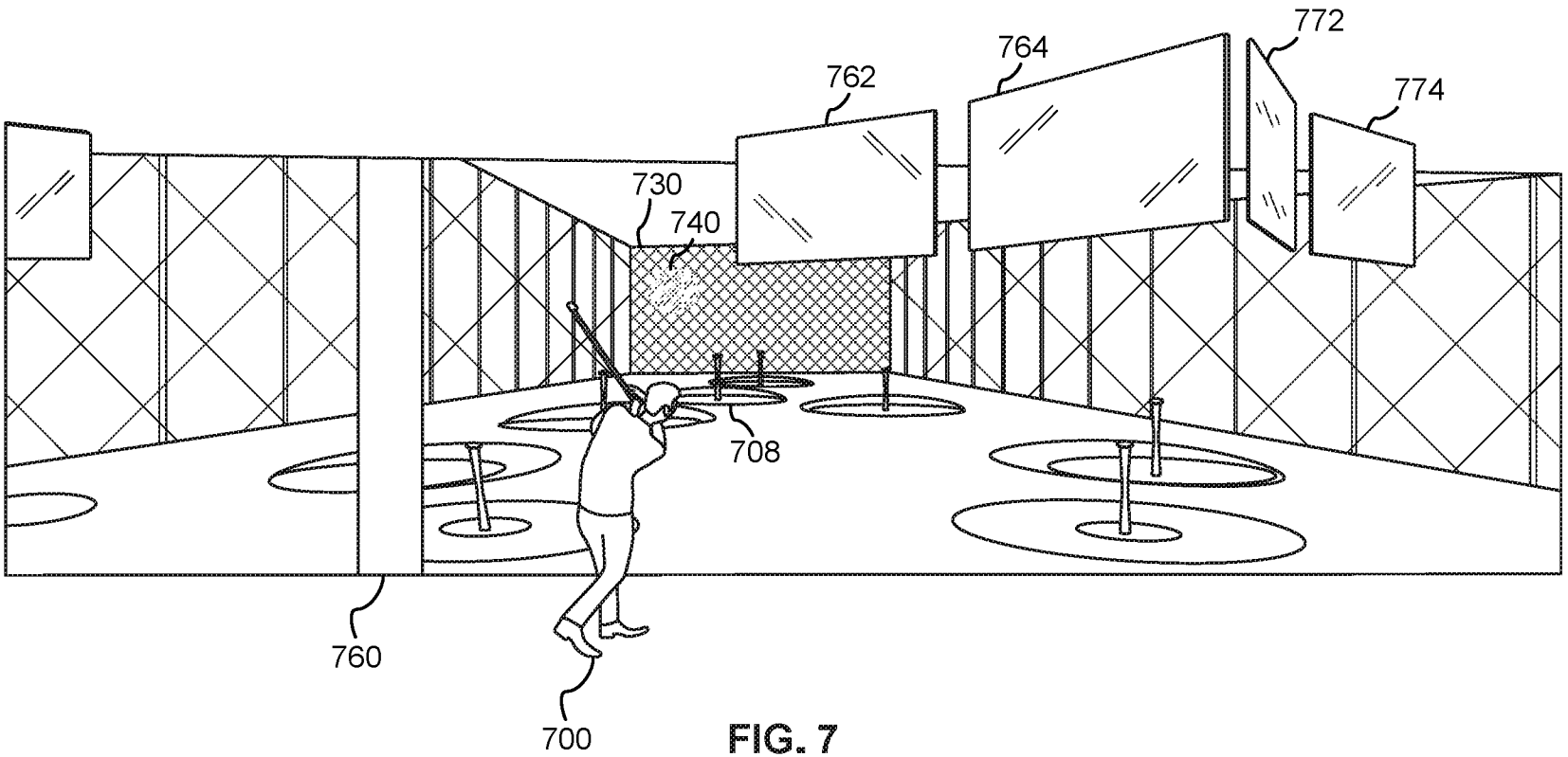
FIG. 7 shows an example of a driving range bay with an LED screen.

FIG. 7 shows an example of a driving range bay with an LED screen. Here, the bay is defined by a divider 760. A player 700 is practicing by hitting golf balls towards the back wall, and the player has just hit target 708. Feedback 740 is displayed on LED screen 730 provided in front of the back wall. In various embodiments, each bay has additional displays inside the bay such as screens 762 and 764. Local screens inside the bay displays information such as statistics about the player's swing (mph, accuracy) or other media (such as live sporting event, TV shows, and the like) inside the bay. In various embodiments, the media displayed on screens inside the bay (762, 764) coordinates with the media displayed on the back wall 730. For example, when a target is hit, an animation (fireworks, ripple, etc.) is displayed on a corresponding area of the LED screen behind the back wall, and, on screens 762, 764 coaching advice and swing statistics are displayed. This gives the player multiple pieces of feedback at different points of focus to help the player enjoy the game and improve more.

The driving range may accommodate other bays in addition to the one shown. For example, an adjacent bay has its own screens 772, 774. Although a divider may be provided between bays, the one to the right is not shown here.

Figure 8:
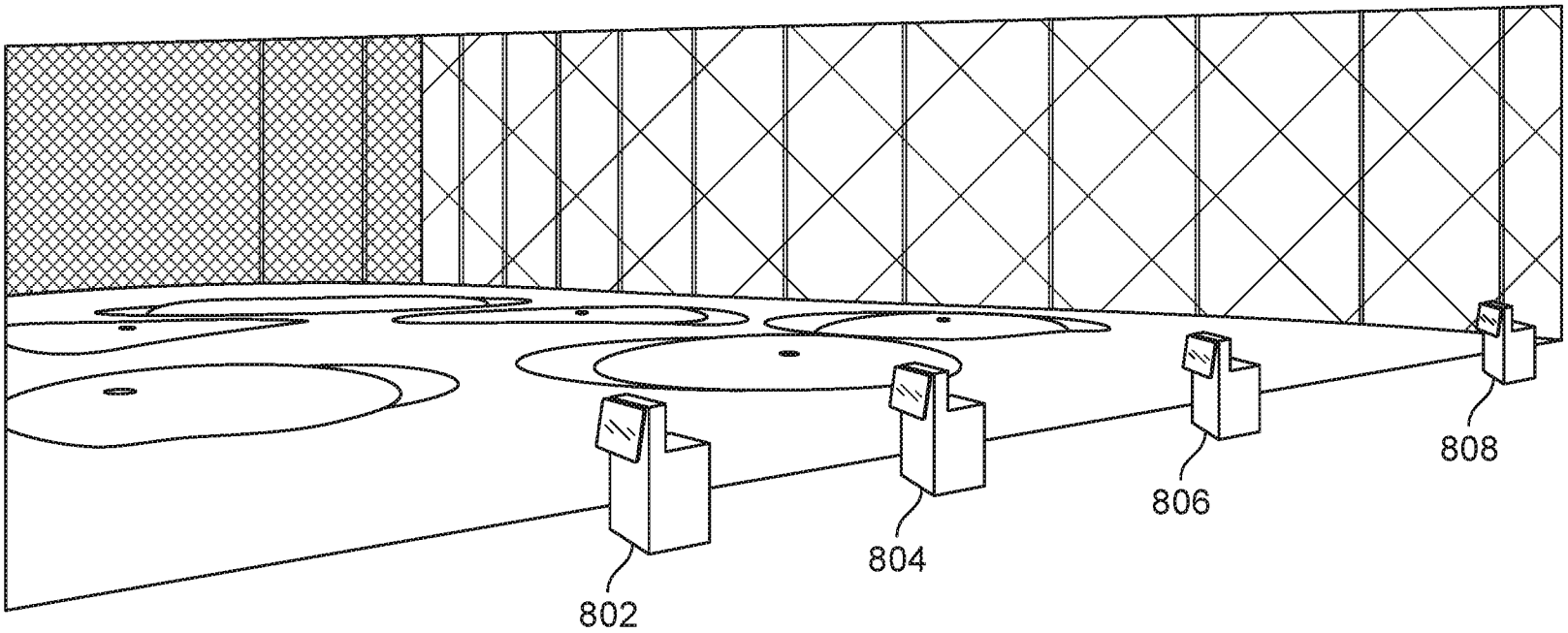
FIG. 8 shows an example of several bays of a driving range with an LED screen.

FIG. 8 shows an example of several bays of a driving range with an LED screen. Here, the bays are defined by respective kiosks 802, 804, 806, and 808. One or more players for each bay may stand near the respective kiosk and hit golf walls towards back wall 830. The LED screen can display feedback for several players simultaneously.

Figure 9:
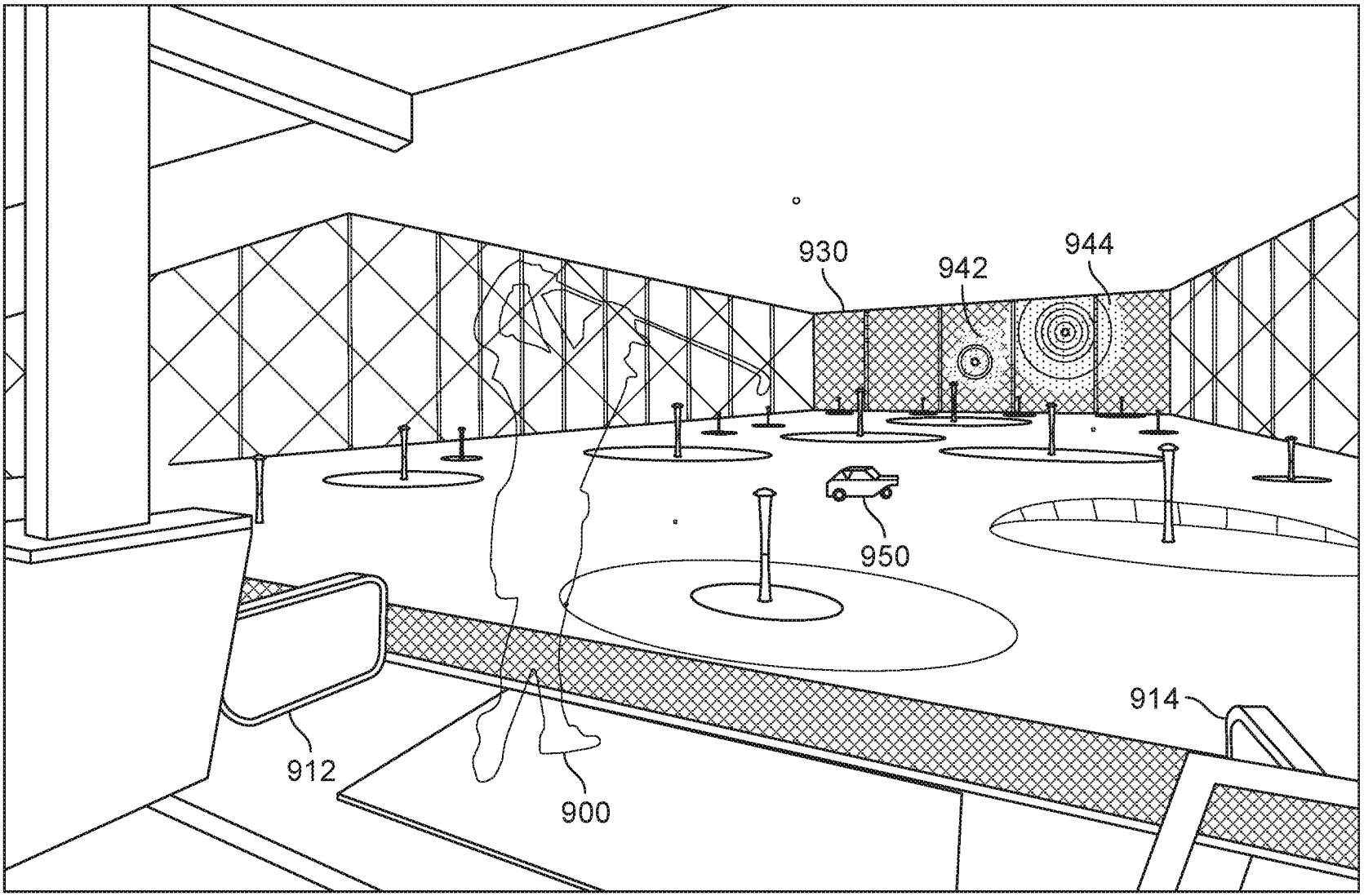
FIG. 9 shows an example of a driving range with an LED screen providing an augmented gaming experience.

FIG. 9 shows an example of a driving range with an LED screen providing an augmented gaming experience. In this example, the golfer 900 in the bay defined by the bay dividers 912 and 914 is practicing. Simultaneously, other golfers are also practicing. As shown, there are three golf balls currently in the field. Feedback is provided on the back wall. Here, two separate targets have been hit and this is reflected on the back wall 930. The field has a number of physical targets and virtual targets. Here, there is virtual target 950 in the form of an automobile. When a player hits this virtual target, special feedback can be reflected on the back wall such as an animation of a visually distinguished color 942 or 944 or message like "jackpot!"

The LED screen supports multi-player games, which may be competitive or collaborative. For example, different teams can compete for common targets displayed on the LED screen and/or field targets. Although described for displaying video graphics content to augment a gaming experience in an interactive golf range, the LED screen disclosed here finds application in other settings such as digital signage for advertising, mass messaging, and top-of-the-hour activities.

Although the foregoing embodiments have been described in some detail for purposes of clarity of understanding, the invention is not limited to the details provided. There are many alternative ways of implementing the invention. The disclosed embodiments are illustrative and not restrictive.

What is claimed is:

1. A system comprising:

a plurality of enclosures each housing LED nodes, wherein the plurality of enclosures is arranged in a plurality of continuous rows formed by directly contacting enclosures with air gaps between adjacent rows to form an LED screen adapted to be provided as a background integrated with a foreground field of a sports range to visually increase a size of the sports range;

a coupler configured to couple a first one of the plurality of enclosures to a second one of the plurality of enclosures;

an LED processor configured to control each of the LED nodes via the coupler to display media on the LED screen; and a net provided in front of the LED screen, wherein the net is adapted to be tensioned to slow travel of a ball towards the LED screen.

2. The system of claim 1, further comprising a media server configured to scale an image for display on the LED screen, wherein the media server is communicatively coupled to the LED processor.

3. The system of claim 2, wherein the media server is configured to map the image to channels corresponding to the LED nodes.

4. The system of claim 2, further comprising a ball tracking server configured to track movement of a ball, wherein the ball tracking server is communicatively coupled to the media server.

5. The system of claim 4, wherein the media server is configured to select media to be displayed on the LED screen based on the tracked movement of the ball.

6. The system of claim 4, wherein the media server is configured to select media to be displayed on the LED screen based on the tracked movement of the ball with respect to a target.

7. The system of claim 4, wherein the media server displays feedback on the LED screen based on a trajectory of the ball detected by the ball tracking server.

8. The system of claim 1, wherein the coupler includes a pair of leads, a first lead configured to deliver power to an LED node and a second lead configured to deliver data to the LED node.

9. The system of claim 1, wherein the coupler is configured to attach a first pair of enclosures to each other end-to-end and attach a second pair of enclosures to each other end-to-end.

10. The system of claim 1, wherein at least one enclosure in the plurality of enclosures is structured to be a height of an LED node and a width of a plurality of LED nodes.

11. The system of claim 1, further comprising a plurality of vertical suspension cables adapted to support the plurality of enclosures, wherein the plurality of enclosures is arranged horizontally with respect to the plurality of vertical suspension cables.

12. The system of claim 11, wherein an enclosure is fixed to the vertical suspension cables at a plurality of attachment points.

13. The system of claim 1, wherein space between a first row of enclosures and a second row of enclosures is open to air.

14. The system of claim 1, wherein each of the LED nodes includes at least one red LED, at least one green LED, and at least one blue LED.

15. The system of claim 1, wherein each enclosure in the plurality of enclosures is less than 1 inch tall and more than 5 feet wide.

16. A system comprising:

a field defined by a perimeter and a back wall extending vertically from a portion of the perimeter;

a physical target provided on the field; and an LED screen provided as an overlay on the back wall the LED screen including:

a plurality of enclosures each housing LED nodes, the plurality of enclosures arranged in a plurality of continuous rows formed by directly contacting enclosures with air gaps between adjacent rows, wherein the LED screen is configured to display a simulated target and media based at least in part on a movement of a ball inside the field including proximity of a ball to at least one of the physical target and the simulated target.

17. The system of claim 16, further comprising a plurality of bays opposite the back wall, wherein the ball originates from the plurality of bays.

18. The system of claim 16, wherein the field includes at least one other simulated target.

19. The system of claim 16, wherein the LED screen is adapted to be visually integrated with the field to visually increase a size of the field.

20. The system of claim 16, further comprising a net provided in front of the LED screen, wherein the net is adapted to slow travel of ball towards the LED screen.

21. A method comprising:

tracking, by a processor, a location of a ball within a playing field, wherein the playing field is defined by a perimeter and a back wall extending vertically from a portion of the perimeter and a physical target is provided on the playing field;

determining, by the processor, media to be displayed based on the tracked location of the ball including proximity of the ball to at least one of the physical target and a simulated target;

mapping the determined media to an LED screen, wherein the LED screen:

includes a plurality of enclosures each housing LED nodes, each enclosure directly contacting another one of the plurality of enclosures with air gaps between adjacent rows to form a plurality of continuous rows;

is provided as an overlay on the back wall and integrated with the playing field to visually increase a size of the playing field; and displays the simulated target; and instructing an LED processor to drive LED nodes of the LED screen to display the mapped media.

22. The method of claim 21, wherein the location of the ball is tracked by a 3D Doppler tracker.

23. The method of claim 21, wherein the mapping of the determined media to the LED screen includes scaling the media based at least in part on a resolution of the LED screen.

* * * * *